United States Patent [19]

Mafli

[11] Patent Number: 4,477,946

[45] Date of Patent: Oct. 23, 1984

[54] DEVICE FOR RECEIVING AND FIXING A FLOWER

[75] Inventor: Reinald Mafli, Urdorf, Switzerland

[73] Assignee: MAFAG AG fur Feinmechanik, Urdorf, Switzerland

[21] Appl. No.: 450,383

[22] Filed: Dec. 16, 1982

[30] Foreign Application Priority Data

Feb. 4, 1982 [CH] Switzerland ..... 671/82

[51] Int. Cl.[3] ..... A45F 5/08

[52] U.S. Cl. ..... 24/5; 24/6; 24/12; 24/13

[58] Field of Search ..... 24/5, 6, 12, 13

[56] References Cited

U.S. PATENT DOCUMENTS

| | | | |
|---|---|---|---|
| D. 123,835 | 12/1940 | Goodman | 24/6 |
| 568,114 | 9/1896 | Johnston | 24/6 |
| 882,178 | 3/1908 | Sloat | 24/13 |
| 1,072,903 | 9/1913 | Bippart | 24/6 |
| 1,592,531 | 7/1926 | Magid | 24/12 |
| 1,730,774 | 10/1929 | Lesiak | 24/12 |
| 2,296,449 | 9/1942 | Meisenheimer | 24/13 |
| 2,435,818 | 2/1948 | Cohen | 24/6 |
| 2,660,771 | 12/1953 | Barlengo | 24/5 |
| 3,349,441 | 10/1967 | Turner et al. | 24/6 |
| 4,165,621 | 8/1979 | Gould | 24/13 |

FOREIGN PATENT DOCUMENTS

| | | | |
|---|---|---|---|
| 637198 | 4/1928 | France | 24/6 |
| 14048 | 4/1912 | United Kingdom | 24/13 |
| 405 | 2/1914 | United Kingdom | 24/6 |
| 550111 | 12/1942 | United Kingdom | 24/6 |

*Primary Examiner*—Victor N. Sakran
*Attorney, Agent, or Firm*—Yount & Tarolli

[57] ABSTRACT

A device for fixing a flower or a bundle of flowers to a dress or similar clothing comprises a body means including a head portion, equipped with a safety pin, and an elongate shaft portion rigidly connected to the head portion. The flowers to be connected to the device are aligned with their stem to the shaft portion and an adhesive tape is wrapped around the shaft portion and the stems. The device is then fixed to the dress by means of the safety pin like a badge.

3 Claims, 3 Drawing Figures

DEVICE FOR RECEIVING AND FIXING A FLOWER

The present invention relates to a device for receiving a flower or a plurality of flowers and for fixing said flower or said plurality of flowers in a predetermined position with respect to an object, especially to a dress or similar clothing.

It is common practice to fix a flower or a plurality of flowers to one's dress on festive occasions. Hitherto, one has used pins or safety pins to fix the flower or flowers to the dress, whereby the pin or safety pin has been pushed through the stem of the flower as well as through a surface portion of the dress to connect it to the dress or like clothing. However, it has been proven to be difficult to achieve a satisfactory anchorage of the flower or flower bundle on the dress in this way. Amongst other problems, the flower or flower bundle has the tendency to tilt about the fixing point on the dress, resulting in an oblique or even inverse position of the flower.

It is an object of the present invention to provide a device for receiving a flower or a plurality of flowers and for fixing said flower or plurality of flowers in a predetermined position with respect to an object, especially to a dress or similar clothing, which device does not exhibit the disadvantage set out hereinbefore.

According to the invention, the device of the kind as drescribed comprises a body means including a head portion and an elongate shaft portion, said body means being equipped with a safety pin.

Such a device may be similar to a badge for fixing to one's cloth, but further comprising an elongate shaft portion, the stem of the flower and said shaft portion being wrapped by a tape or similar means to fix the stem of the flower to the elongate shaft portion and thereby to secure the flower to the device.

A preferred embodiment of the device according to the invention is shown in the accompanying drawings, in which.

Figure 1:
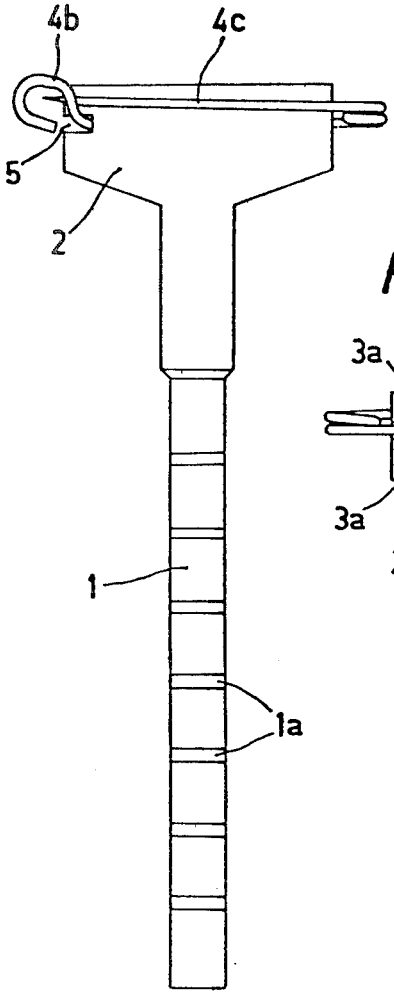
FIG. 1 shows a view from the back side.
Figure 2:
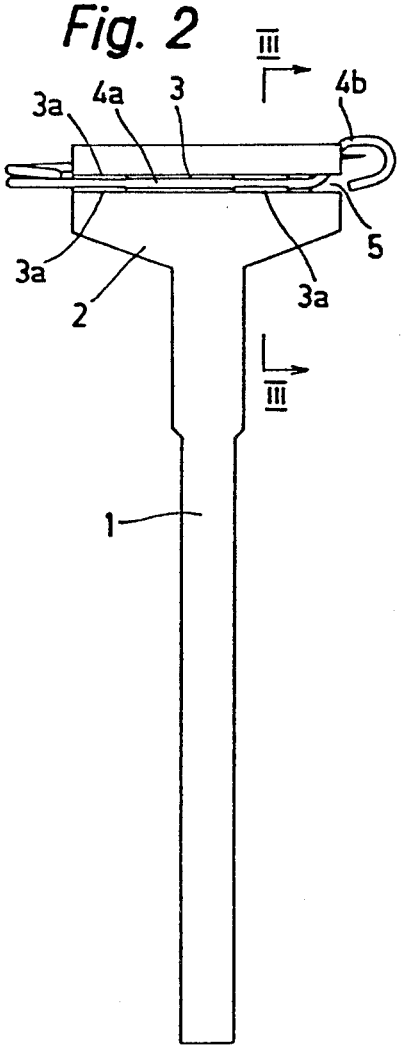
FIG. 2 shows a front view of the device according to the invention.
Figure 3:
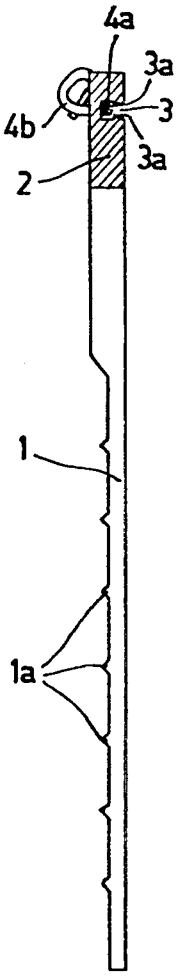
FIG. 3 shows a partial, sectional view along line III—III in FIG. 2.

The device for receiving and fixing a flower, shown in the drawings, may have in fact, a height of about 5 cm. It comprises a body means including an elongate shaft portion 1 and a head portion 2, said head portion being rigidly connected to the one end of said elongate shaft portion 1. Preferably, said head portion 2 and said shaft portion 1 are constructed in one piece, e.g. of plastic or similar synthetic material.

The frontal surface of the head portion 2 of the body means is equipped with a transversal groove 3 extending over the whole width of the head portion. A first leg **4*a* of a safety pin is received in said groove 3 and secured therein. For this purpose, the frontal region of the sidewalls of the groove 3 are equipped with projections 3*a* extending into the groove 3 and keeping said leg 4*a* fixedly secured in the groove 3**.

One of the sides of the head portion 2 comprises a slit 5, and an end portion of said first leg **4*a* of the safety pin, being bent out of the axis of said leg, is received in said slit to prevent said safety pin from being tilted relative to head portion 2, or at least to limit a tilting movement of the safety pin relative to the head portion 2** to a predetermined, small value.

The second leg **4*c* of the safety pin comprises an acute tip and is disposed at the back side of the head portion 2 of the device (FIG. 1**).

In use, a flower or a small bundle of flowers is put onto the front side of the device so that the stem of the flower or the stems of the flowers is aligned with the shaft portion 1 of the body of the device. Consequently the heads of the flowers are in the region of the head portion 2 of the device. Using a tape or similar means, preferably an selfadhesive tape, the stems of the flowers are secured to the shaft portion 1 of the device by wrapping the tape around the stems and the shaft portion. Thereby, the flower or the bundle of flowers is secured to the device. The shaft portion 1 comprises a plurality of transversal ribs **1*a***, which prevent the tape from gliding away.

Now, the device, together with the flower or flowers secured thereto, can be fixed to a dress or other clothing, by means of the safety pin **4*a*, 4*b*, 4*c*. The fixing of the device is accomplished in the manner of a badge by pushing the leg 4*c* through a surface portion of a dress and securing the free end of said leg 4*c* to the bent-out portion 4*b*** of the safety pin.

In this way, a flower or a small flower bundle can be securely fixed to a dress or similar clothing. As the connecting point of the device, i.e. the safety pin **4*a*, 4*b*, 4*c***, has a position which is relatively high compared with the position of the flower or flower bundle, — using behind the head of the flower or the flowers of a bundle —, there is no danger that the flower arrangement may tilt into an oblique or inverse position.

What I claim is:

1. A fastening device to which a flower may be secured by a tape and which device may be pinned onto an article, said device comprising a body means including a head portion and an elongated shaft portion having a surface for supporting the flower stem, a safety pin fixed to said head portion, said safety pin comprising a first leg having a straight portion and an end portion bent relative to said straight portion, said head portion having a groove extending along the width thereof for receiving said straight portion of said first leg of said safety pin and having a slit at one end of said groove for receiving said end portion of said first leg, a plurality of projections extending into said groove for retaining said straight portion of said first leg therein to thereby hold said safety pin to said head, said elongated shaft portion being adapted to have a tape encircling it and a flower stem on it and said elongated shaft portion comprising a plurality of transverse ribs on the surface thereof that is opposite to the surface that supports the stem for preventing a tape that secures the flower stem to said elongated shaft portion from sliding therealong.

2. A device according to claim 1 wherein said body means having a head portion and an elongated shaft portion is a one-piece homogeneous structure.

3. A device according to claim 1 wherein said safety pin comprises a second leg with acute tip, said second leg being disposed essentially at a right angle to said shaft portion.

* * * * *